US008950958B2

(12) United States Patent
Fallica

(10) Patent No.: US 8,950,958 B2
(45) Date of Patent: Feb. 10, 2015

(54) PRINTER WITH COVER RETRACTABLE AROUND PAPER ROLL

(75) Inventor: Antonino Giovanni Fallica, Pioltello (IT)

(73) Assignee: K.F.I. S.R.L., Binasco (MI) (IT)

( * ) Notice: Subject to any disclaimer, the term of this patent is extended or adjusted under 35 U.S.C. 154(b) by 88 days.

(21) Appl. No.: 13/808,599

(22) PCT Filed: Jul. 6, 2011

(86) PCT No.: PCT/IB2011/052999

§ 371 (c)(1), (2), (4) Date: Jan. 7, 2013

(87) PCT Pub. No.: WO2012/004754

PCT Pub. Date: Jan. 12, 2012

(65) Prior Publication Data

US 2013/0108348 A1 May 2, 2013

(30) Foreign Application Priority Data

Jul. 7, 2010 (IT) ..... TO2010A0587

(51) Int. Cl.

| | |
|---|---|
| ***B41J 29/13*** | (2006.01) |
| ***B41J 11/58*** | (2006.01) |
| ***B41J 15/04*** | (2006.01) |

(52) U.S. Cl.

CPC *B41J 11/58* (2013.01); *B41J 29/13* (2013.01); *B41J 15/042* (2013.01)

USPC ..... 400/613; 400/691; 400/693; 347/222

(58) Field of Classification Search

CPC ..... B41J 29/13; B41J 2402/442; B65H 2402/442

USPC ..... 400/693, 613, 691; 347/108, 222

See application file for complete search history.

(56) References Cited

U.S. PATENT DOCUMENTS

| | | | | |
|---|---|---|---|---|
| 5,411,342 | A * | 5/1995 | Horie et al. | 400/613 |
| 6,022,158 | A | 2/2000 | Nakayama | |
| 6,802,603 | B1 * | 10/2004 | Montagutelli | 347/108 |
| 2005/0232678 | A1 * | 10/2005 | Mochizuki et al. | 400/621 |
| 2008/0068437 | A1 | 3/2008 | Hirai | |
| 2010/0239349 | A1 * | 9/2010 | Sakurai et al. | 400/642 |

FOREIGN PATENT DOCUMENTS

| | | | | |
|---|---|---|---|---|
| EP | 1588857 | A2 | 10/2005 | |
| JP | 2001130792 | A * | 5/2001 | B65H 16/06 |
| JP | 2003136809 | A * | 5/2003 | B41J 29/13 |
| JP | 2009255358 | A * | 11/2009 | B41J 29/13 |

* cited by examiner

*Primary Examiner* — Daniel J Colilla

(74) *Attorney, Agent, or Firm* — Robert E. Alderson, Jr.

(57) ABSTRACT

A printer, particularly for thermal paper is provided. Such printer includes those having a support structure which is fixed in use, and in which there is formed a receptacle for receiving a roll of paper tape which is unwound in use by rotation about an axis, a cover which is hinged to the structure about an axis which is substantially parallel to the unwinding axis of the roll, and which can be oscillated between a closed position and an open position in which it covers and uncovers the receptacle, respectively, a printing device carried by the support structure, and a transport roller for the paper tape unwound from the roll, interacting with the printing device; the roller being carried by the cover in such a way that it can be coupled to or uncoupled from the printing device as a result of the closing or opening of the cover.

8 Claims, 8 Drawing Sheets

PRINTER WITH COVER RETRACTABLE AROUND PAPER ROLL

CROSS-REFERENCE TO RELATED APPLICATIONS

This application is a National Phase Application of PCT International Application No. PCT/IB2011/052999, International Filing Date, Jul. 6, 2011, claiming priority to Italian Patent Application No. TO2010A000587, filed Jul. 7, 2010, both of which are hereby incorporated by reference in their entirety.

FIELD OF THE INVENTION

The present invention relates to printers in general.

More specifically, the invention relates to a printer, particularly for thermal paper, comprising

- a support structure which is fixed in use, and in which there is formed a receptacle for receiving a roll of paper tape which is unwound in use by rotation about an axis (which may be fixed or movable),
- a cover which is hinged to the support structure about an axis substantially parallel to the unwinding axis of the roll, and which can be oscillated between a closed position and an open position in which it covers and uncovers the receptacle, respectively,
- a printing device carried by the support structure, and
- a transport roller for the paper tape unwound from the roll, interacting with the printing device; the transport roller being carried by the cover in such a way that it can be coupled to or uncoupled from the printing device as a result of the closing or opening of the cover.

BACKGROUND OF THE INVENTION

Printers of this type are called "easy loading" (or "drop-in") printers, because their configuration, in which the transport roller can be separated from the printing device, allows easier loading of the paper roll into the roll carrier receptacle or compartment.

There are known printers of this type in which the cover is hinged to (pivoted on) the support structure at one of its ends. In these printers, the cover occupies a considerable space outside the printer in its oscillation between the closed and open positions, and this space must therefore be kept free to allow correct opening and closing. Furthermore, in the open position, the cover projects from the associated support structure of the printer and is particularly exposed to the risk of damage.

SUMMARY OF THE INVENTION

One object of the present invention is to provide a printer in which the aforementioned drawbacks of the prior art printers are overcome.

This and other objects are achieved according to the invention by means of a printer of the type defined above, characterized in that the cover comprises a hollow shell hinged to the support structure about an axis close to or coincident with the unwinding axis of the paper roll, in such a way that the shell is slidable between the open position and the closed position while remaining adjacent to the receptacle (at a fairly small distance, for example a few millimeters), and (also) extends substantially around the paper roll when in the open position.

Further features and advantages of the invention will become apparent from the detailed description and reference to the appended drawings briefly described below.

DETAILED DESCRIPTION

Figure 1:
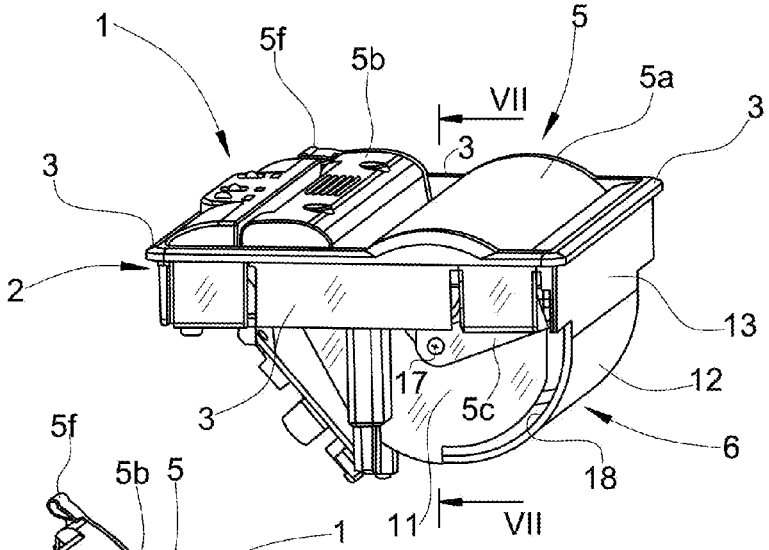
FIGS. 1 to 3 are perspective views of a first embodiment of a printer according to the invention, shown with the cover placed in the closed position, in an intermediate position, and in the fully open position, respectively.

In the drawings, a printer according to the present invention is indicated as a whole by 1.

In the embodiment illustrated in FIGS. 1 to 11, the printer 1 comprises a support structure which is fixed in use, indicated as a whole by 2. This support structure 2 has a front part 3 in the form of a frame, particularly a rectangular frame, in which is defined an aperture 4, also of substantially rectangular shape, which is associated with a cover indicated as a whole by 5 (see FIG. 6 in particular).

The support structure 2 also has a rear part, indicated as a whole by 6, which extends from the front frame-like part 3 and in which is defined a receptacle 7 for receiving a paper roll 8 (see, in particular, FIGS. 4, 5, 7 and 8).

The receptacle 7 faces and communicates with the aperture 4 of the front frame-like part 3.

Figure 10A:
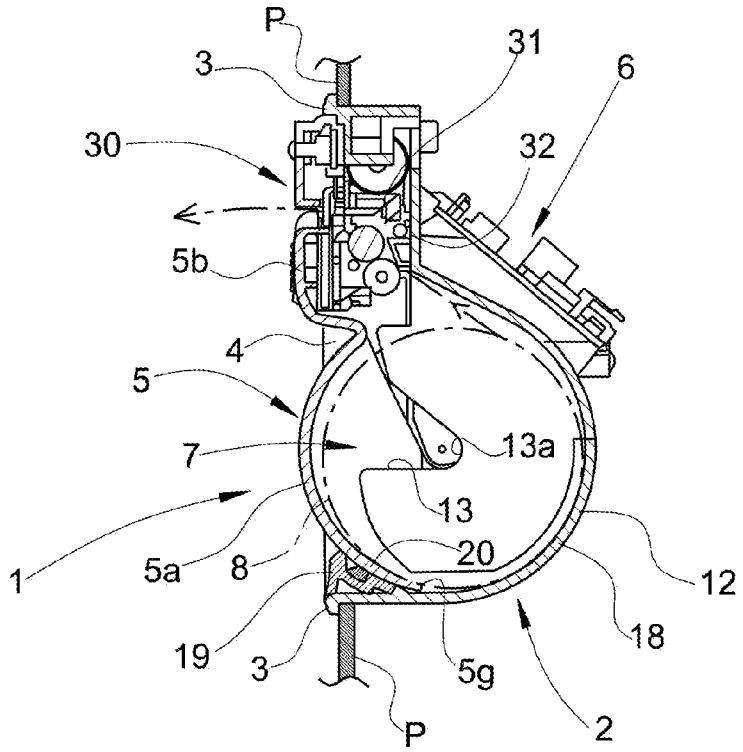
FIGS. 10*a* and 10*b* are sectional views showing a printer according to the invention in a condition of vertical mounting and in a condition of horizontal mounting, respectively.
Figure 10B:
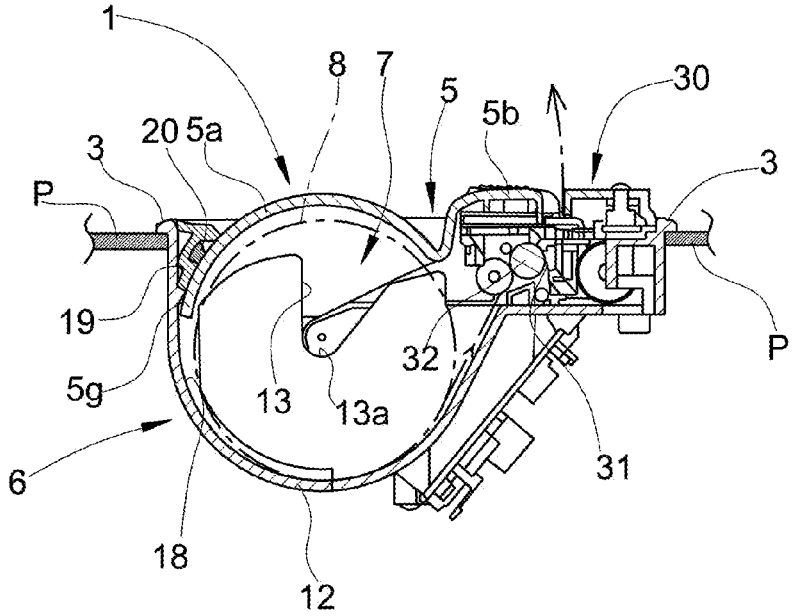

Adjacently to the receptacle 7, in the support structure 2, particularly in its frame-like part 3, there is mounted a printing device indicated as a whole by 30 (see, for example, FIGS. 2, 3, 8, 10*a* and 10*b*), of a known type, including a thermal print head 31 (FIGS. 10*a* and 10*b*).

With reference to FIGS. 4, 5, 7-9, in the exemplary embodiment illustrated the paper roll 8 is provided with a spool including a shaft 9, designed to be mounted rotatably about a fixed axis in the support structure 2, as described more fully below. However, it is not necessary for the paper roll 8 to be provided with a spool or shaft of this type, since the roll can simply be placed on the base of the receptacle 7.

Figure 4:
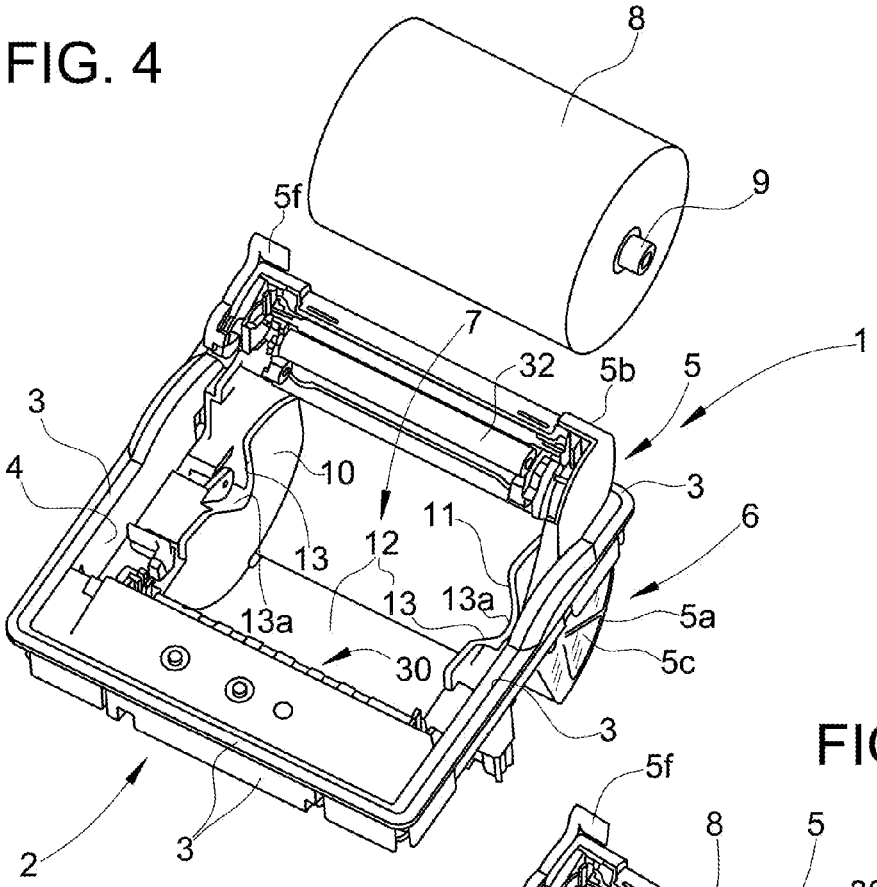
FIGS. 4 and 5 are perspective views of the printer shown in FIG. 1, illustrating the procedure for receiving a roll of paper.
Figure 5:
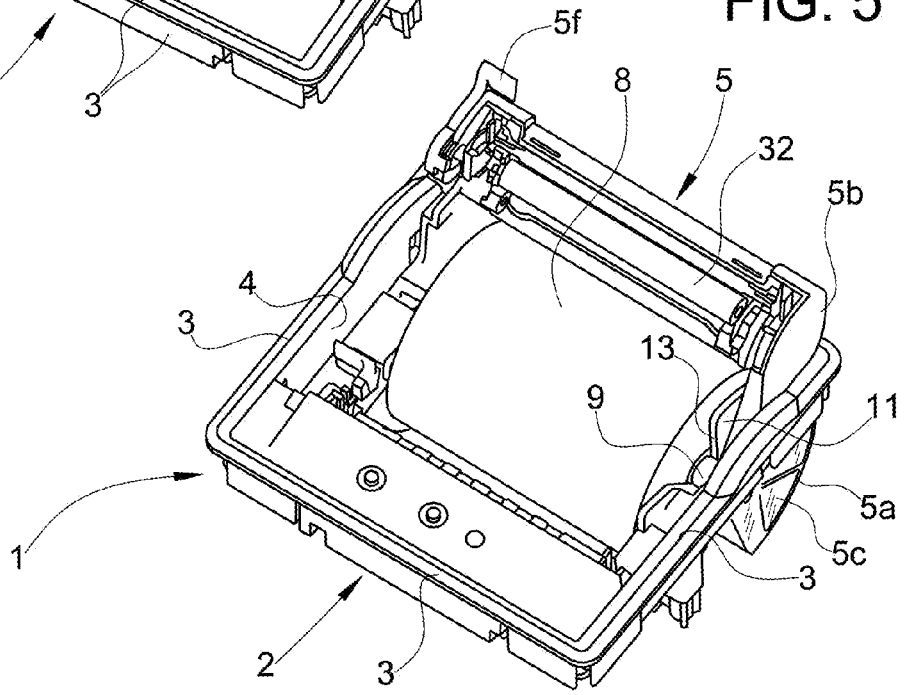

With reference to FIG. 4 in particular, the receptacle 7 has two facing shaped end walls 10 and 11, between which a curved wall 12 extends.

Figure 2:
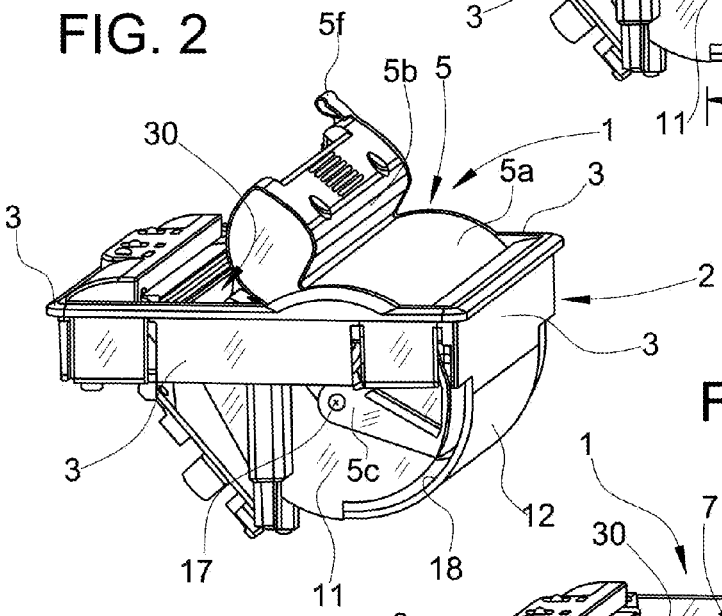
Figure 6:
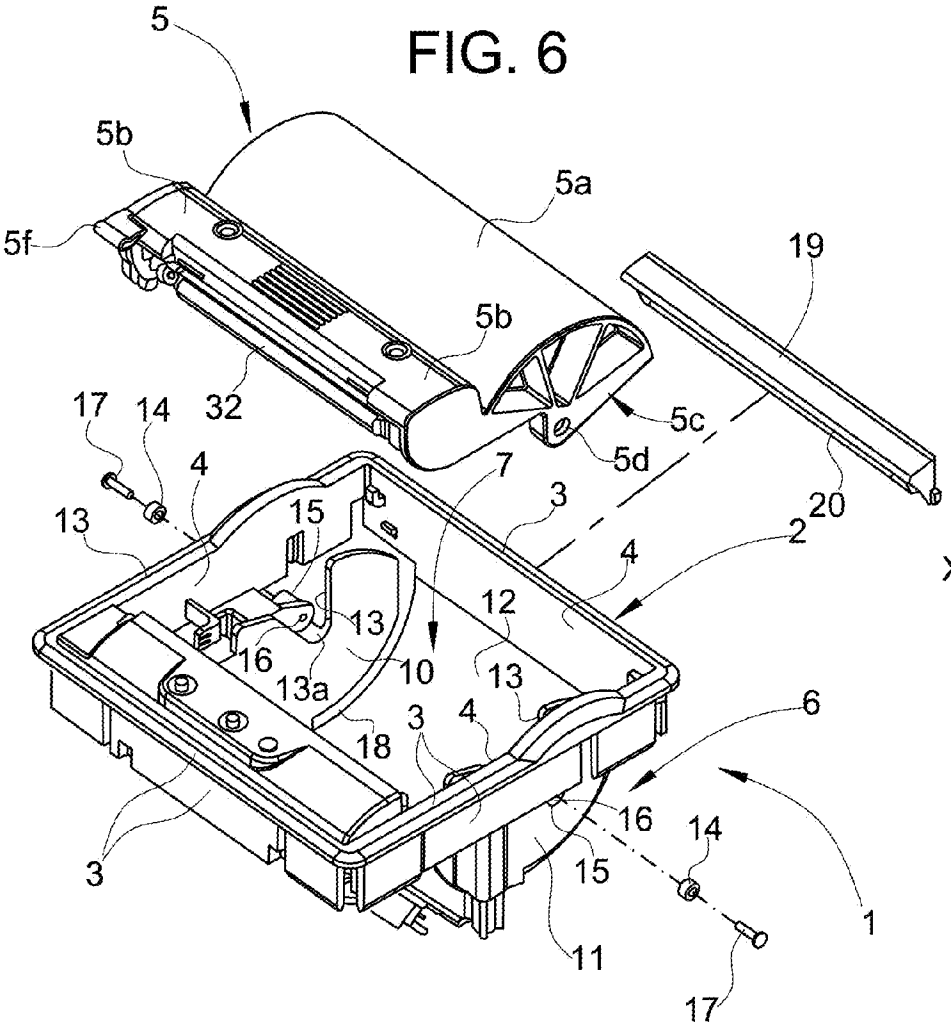
FIG. 6 is a partially exploded perspective view of the printer shown in the preceding drawings.

In the exemplary embodiment illustrated, the cover 5 has a main shell portion 5*a* and an adjacent auxiliary shell portion 5*b*, which are interconnected to form a kind of cusp (see FIGS. 1, 2 and 6 in particular).

The main shell 5*a* is designed to cover the receptacle 7 housing the paper roll 8.

In the auxiliary shell 5*b* there are mounted a rubber-coated roller 32 for transporting the paper tape unwound from the roll 8, and associated transmission and rotation gear systems (see, for example, FIGS. 3 to 5, 10*a* and 10*b*). The roller 32 and the associated gear systems can be coupled to or uncoupled from the printing device 30 by the closing or opening of the cover 5. In the coupled condition, the roller 32 can transport the paper tape when printing is carried out, and ensures that the tape is in contact with the surface of the print head 31.

With reference to FIGS. 4 and 6-9, the end walls 10 and 11 of the receptacle 7 have respective indentations 13, essentially in the shape of a V with a rounded bottom 13*a*, which can act as seats for the rotation of corresponding ends of the shaft 9 carrying the roll 8.

The indentations 13 of the side walls 10 and 11 of the receptacle 7 can be shaped in the form of a U, rather than in the form of a V with a rounded vertex.

As shown, for example, in FIGS. 1 to 3 and 6, the cover 5 has two side formations 5*c* at its ends, essentially in the form of walls in the shape of sectors of circles, provided with respective pluralities of radial stiffening ribs. These side formations 5*c* of the cover are provided with respective circular end apertures, indicated by 5*d* (FIG. 6). Corresponding rotation supports in the form of bushes 14 are mounted in these apertures 5*d* (FIGS. 6 and 7).

Figure 7:
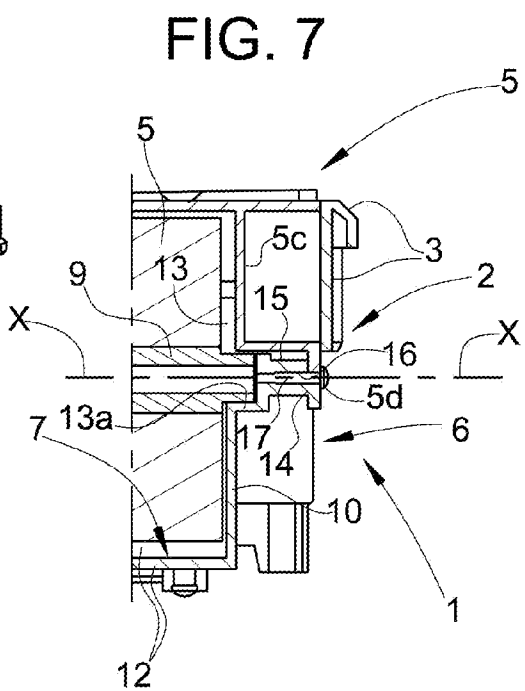
FIG. 7 is a partial sectional view taken along the line VII-VII of FIG. 1.

In the facing walls 10 and 11 of the receptacle 7 there are formed respective protuberances 15, in which respective axially aligned holes 16 are formed, as indicated by 16 in FIGS. 6 and 7.

In assembly, the cover 5 is fitted into the support structure 2 through the aperture 4 of its frame portion 3. The side formations 5*c* of the shell 5*a* of the cover 5 pass through corresponding gaps formed between the walls 10 and 11 and the adjacent sides of the frame-like portion 3 of the support structure 2 until their apertures 5*d*, with the bushes 14 prefitted in them, are aligned with the holes 16 of the formations 15 of the side walls 10 and 11 of the receptacle 7. In this condition, self-tapping screws 17 are introduced through the bushes 14 and screwed into the holes 16, thus securing the coupling between the cover 5 and the support structure 2. This coupling allows the cover 5 to oscillate about the axis of the holes 16, this axis being indicated by X-X in FIG. 7.

Figure 8:
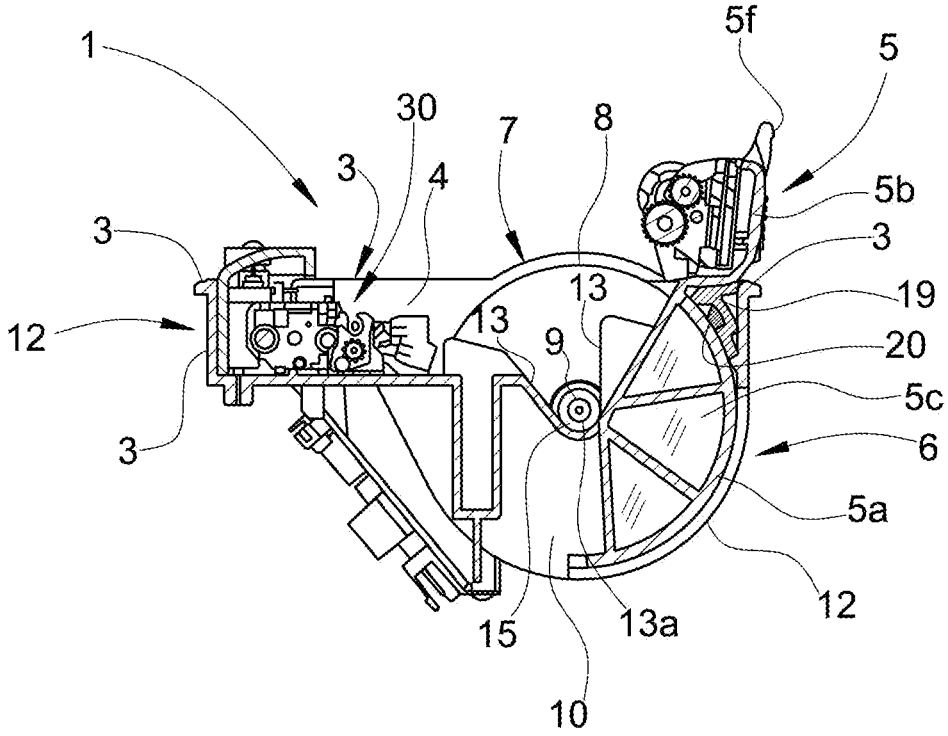
FIGS. 8 and 9 are sectional views showing the printer with the cover in the open and closed position, respectively.

With reference to FIG. 8, when the cover 5 is in the open position, its side end formations 5*c* are positioned in such a way that they do not interfere with the introduction or extraction of the roll carrier shaft 9 into or from the associated seats 13, 13*a*.

Figure 9:
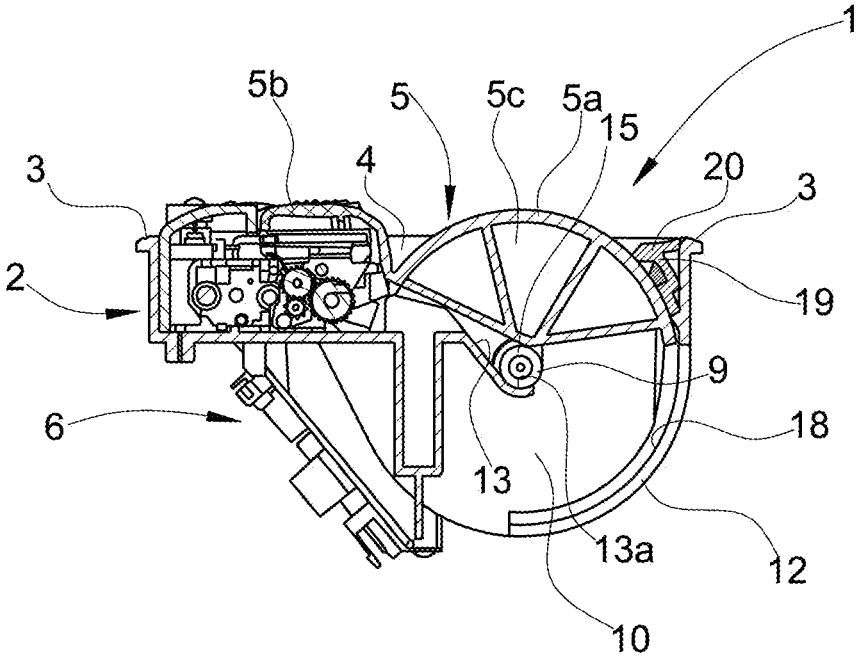

As shown in FIG. 9, when the cover 5 is in the closed position its side end formations 5*c* are positioned in such a way that the ends of the shaft 9 cannot leave the corresponding housing seats 13*a*.

As explained in the above description, and as can be seen in the attached drawings, the axis of oscillation of the cover 5 with respect to the support structure 2 is parallel to the axis of the paper roll 8 and, in general, coincides with the latter axis, or, if the paper roll 8 has a shaft or spool, is close to the axis of this roll.

The arrangement is such that the shell 5*a* of the cover 5 is slidable between the open position and the close position while remaining adjacent to the periphery (the curved wall 12) of the receptacle 7, and, in the open position (see, for example, FIGS. 3 and 8), this shell 5*a* extends substantially around the paper roll 8.

In the embodiment illustrated with reference to FIGS. 1 to 11, in the open position of the cover 5, the shell 5*a* of the latter extends within the receptacle 7 provided for the paper roll 8. In this embodiment, the receptacle 7 (FIGS. 1-3 and 6) has a pair of parallel curved slots 18 at its ends, through which the side end formations 5*c* of the cover 5 pass.

Figure 11:
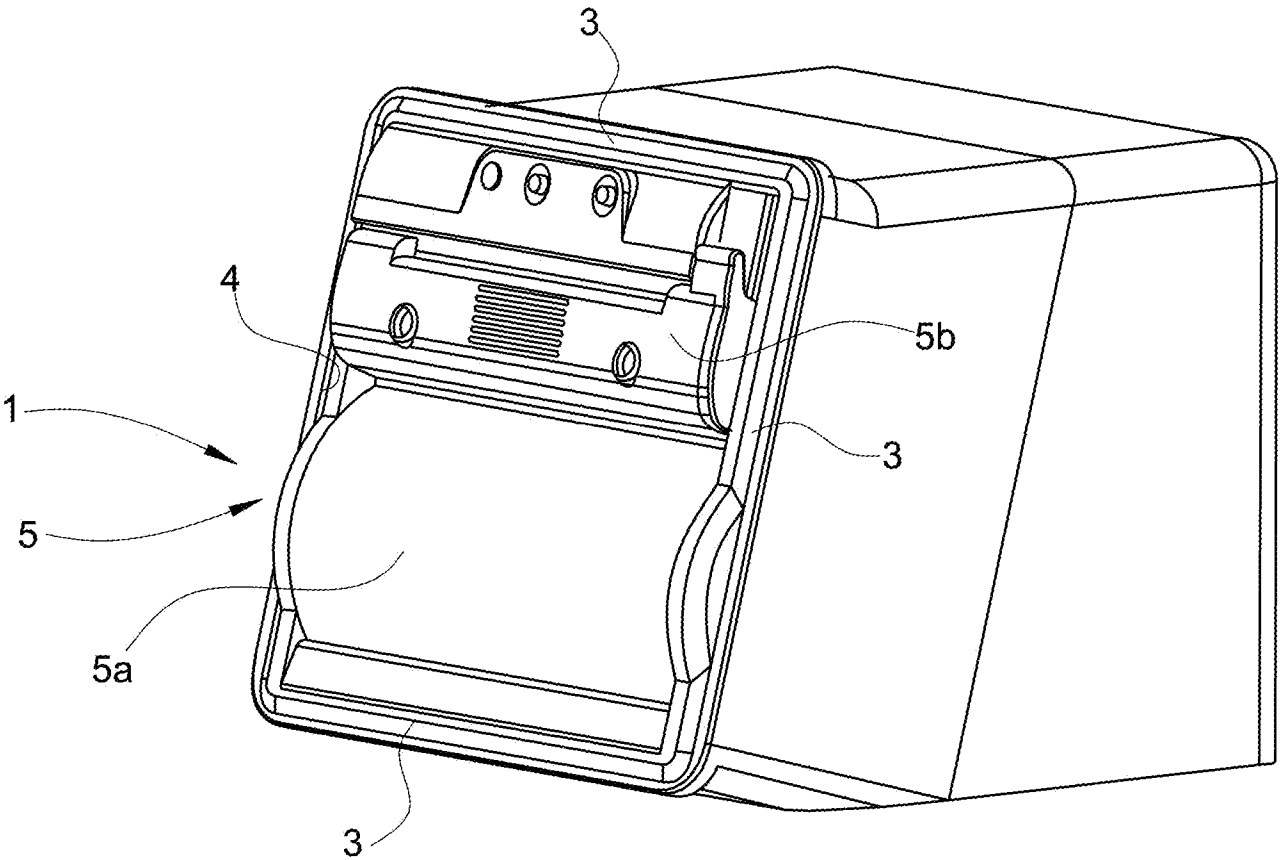
FIG. 11 is a perspective view showing a printer according to the invention, built into the mouth of a box-like body.

During the opening of the cover 5, in order to limit any interference and reduce the friction of the shell 5*a* with the paper roll 8, the end edge 5*g* of this shell is bevelled along the line of contact with the paper roll 8 (FIGS. 10 and 11).

With reference to FIGS. 6 to 11, the frame-like part 3 of the support structure 2 adjacent to the path of the shell 5*a* of the cover is provided with a cross-piece 19 which carries a seal 20 (FIGS. 8-11) adapted to interact with the outer surface of the shell 5*a*, thus stabilizing its position in the open and closed conditions and preventing the ingress of foreign bodies, including the printed paper tape which emerges from the printer.

The printer 1 described above can be built into a corresponding aperture provided in a panel P (FIGS. 10*a* and 10*b*) for use in a vertical configuration (FIG. 10*a*) or in a horizontal configuration (FIG. 10*b*). Alternatively, the printer can be built into the mouth of a hollow box-like body as shown for example in FIG. 11.

Conveniently, guide rollers and part of a cutting device, for cutting the paper tape unwound from the roll 8 and printed by known printing devices fixed to the frame-like part 3 of the support structure 2, can be mounted in the auxiliary shell 5*b* of the cover 5.

Figure 3:
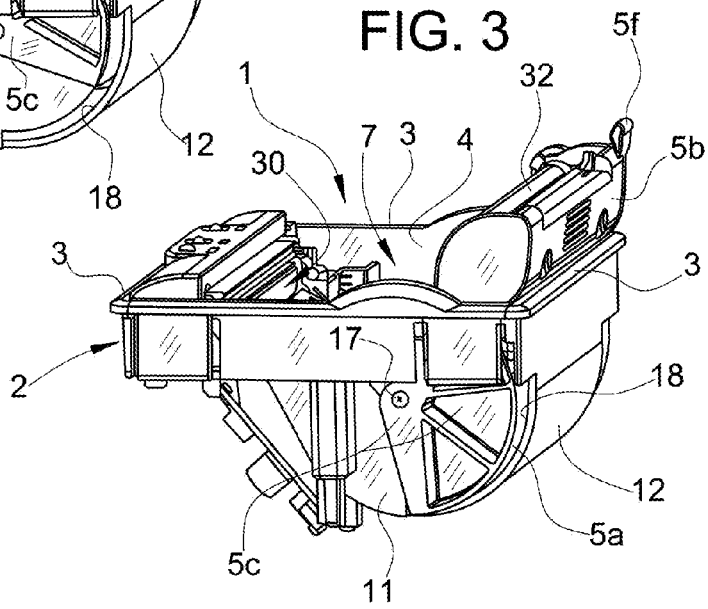

As shown in particular in FIGS. 2 to 4, the auxiliary shell 5*b* of the cover 5 is conveniently provided with an appendage or lever 5*f*, designed to allow the cover 5 to be unlocked from the closed position and to facilitate the grasping of the cover by the user's hand, particularly when the cover is in the closed position, to enable the opening movement to be carried out.

In FIGS. 10*a* and 10*b*, the paper roll 8 and the path followed by the paper tape unwound from this roll in its passage between the movement, guiding, printing and cutting devices are shown in chained lines.

Figure 12:
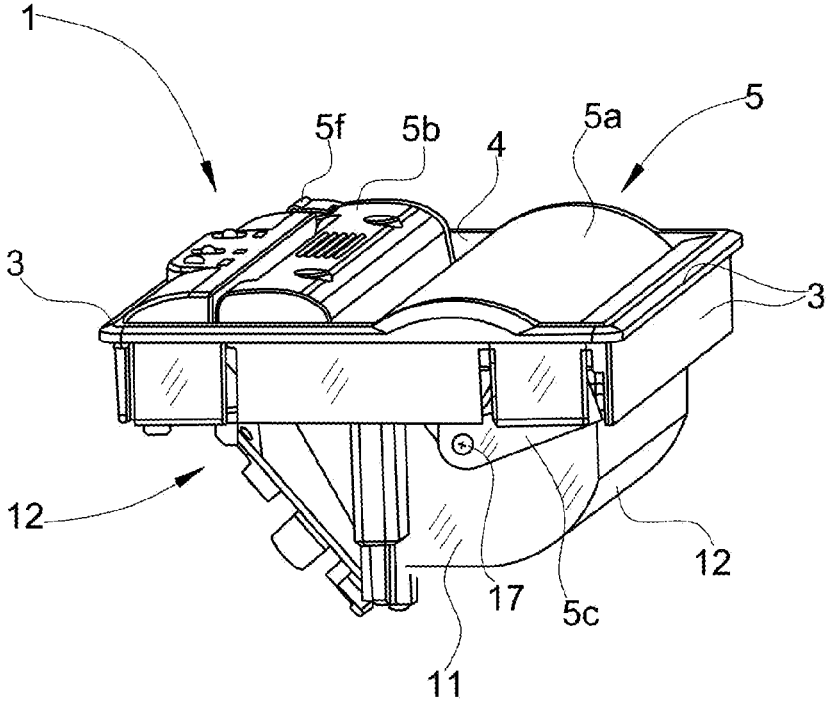
FIG. 12 is a perspective view of another embodiment of a printer according to the invention.
Figure 13:
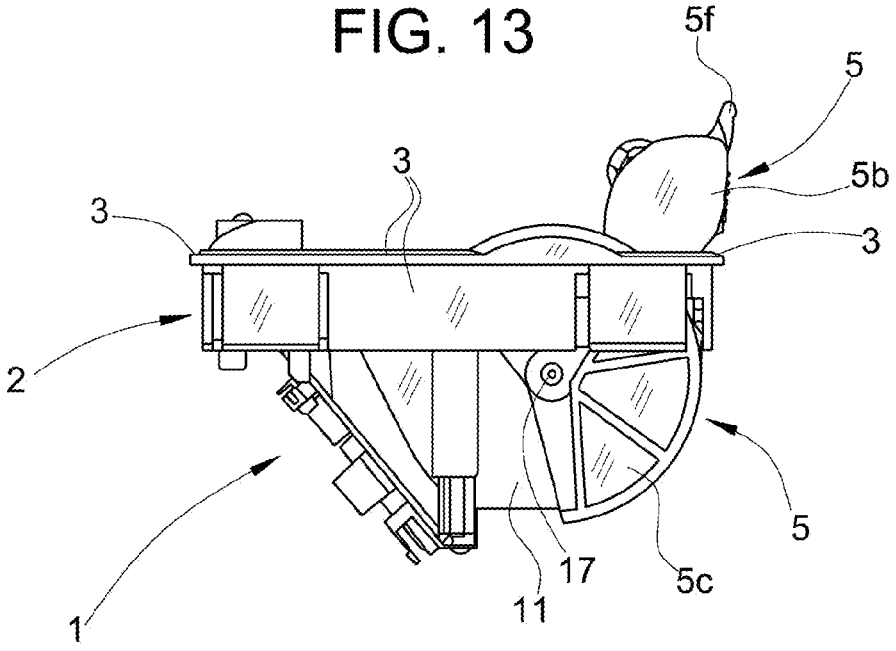
FIG. 13 is a side view of the printer shown in FIG. 12, shown with the cover open.
Figure 14:
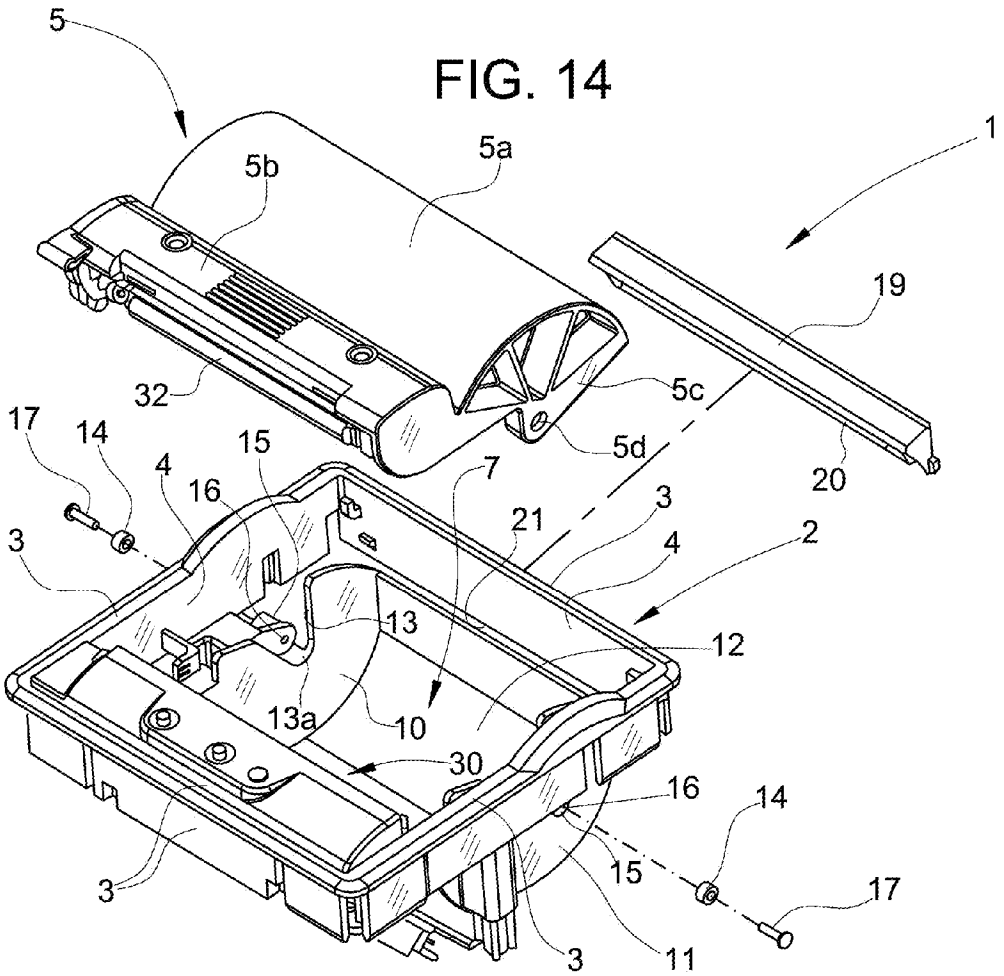
FIG. 14 is a partially exploded perspective view of the printer shown in FIGS. 12 and 13.

FIGS. 12 to 14 show a variant embodiment of a printer according to the invention.

In these figures, parts and elements described previously have been given the same reference numerals as those used previously.

In the variant shown in FIGS. 12 to 14, the main shell 5*a* of the cover 5 extends outside the receptacle 7 provided for the paper roll 8. As shown in FIG. 14, this receptacle 7 has a longitudinal slot 21 through which the shell 5*a* of the cover 5 passes in its oscillation between the open and the closed positions.

Naturally, the principle of the invention remaining the same, the forms of embodiment and the details of construction may be varied widely with respect to those described and illustrated, which have been given purely by way of non-limiting example, without thereby departing from the scope of the invention as defined in the attached claims.

The invention claimed is:

1. A printer, comprising a support structure which is fixed in use, and in which there is formed a receptacle for receiving a roll of paper tape which is unwound in use by rotation about an axis, a cover which is hinged to the structure about an axis substantially parallel to the unwinding axis of the roll, and which can be oscillated between a closed position and an open position in which it covers and uncovers the receptacle, respectively, a printing device carried by the support structure, and a transport roller for the paper tape unwound from the roll, interacting with the printing device; the roller being carried by the cover in such a way that it can be coupled to or uncoupled from the printing device as a result of the closing or opening of the cover;

wherein the cover comprises a hollow shell which is hinged to the structure about an axis which is close to or coincident with the unwinding axis of the roll, in such a way that the shell is slidable between the open position and the closed position while remaining adjacent to the receptacle, and wherein the cover extends substantially around the paper roll when in the open position, and wherein in the open position, the aforesaid shell of the cover extends into the aforesaid receptacle.

2. The printer of claim 1, wherein the receptacle comprises two facing end walls provided with respective holes coaxial with the axis of oscillation of the cover, and in which the cover has at least two side formations provided with respective circular end openings aligned with each other, in which are mounted respective pivotal supports in the form of bushes, through which there extend corresponding fastening members which engage in the holes of the end walls of the receptacle.

3. The printer of claim 2, wherein the end walls of the receptacle comprise respective indentations shaped essentially in the form of a U or a V with a rounded bottom, providing a seat for positioning a corresponding end of a roll carrier shaft, and in which, in the closed position, the aforesaid side formations of the cover are positioned so as to prevent the ends of the shaft from leaving the corresponding seats.

4. The printer of claim 2, wherein the support structure has a front part in the form of a frame, defining an aperture with which the cover is associated, and a rear part in which is formed the aforesaid receptacle, which faces and communicates with the aperture of a front frame-like part.

5. The printer of claim 1, wherein the ends of the receptacle comprise parallel curved slots for the passage of the shell of the cover during movement of the cover.

6. The printer of claim 1, wherein, in the open position, the aforesaid shell of the cover extends outside the aforesaid receptacle.

7. The printer of claim 6, wherein the receptacle includes at least one longitudinal slot which is parallel to the axis of rotation of the cover and which is designed to allow the aforesaid shell of the cover to pass through it during the movement between the open and the closed position.

8. The printer of claim 1, wherein the aforesaid shell of the cover includes a bevelled circumferential end edge.

* * * * *